US011815305B2

(12) United States Patent
Huang et al.

(10) Patent No.: US 11,815,305 B2
(45) Date of Patent: Nov. 14, 2023

(54) REFRIGERATOR

(71) Applicant: BSH Hausgeraete GmbH, Munich (DE)

(72) Inventors: Shili Huang, Chuzhou (CN); Chuanyang Wang, Chuzhou (CN); Gongming Wang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/859,195

(22) Filed: Jul. 7, 2022

(65) Prior Publication Data

US 2023/0014666 A1 Jan. 19, 2023

(30) Foreign Application Priority Data

Jul. 7, 2021 (CN) ..... 202121541451.8

(51) Int. Cl.
*F25D 23/06* (2006.01)

(52) U.S. Cl.
CPC ..... *F25D 23/066* (2013.01); *F25D 23/067* (2013.01)

(58) Field of Classification Search
CPC .... F25D 23/066; F25D 23/067; F25D 23/065; F25D 2400/04; F25D 2400/06
See application file for complete search history.

(56) References Cited

U.S. PATENT DOCUMENTS

| | | | | |
|---|---|---|---|---|
| 4,765,696 | A * | 8/1988 | Cordill | F25D 23/067 312/407 |
| 8,979,224 | B2 * | 3/2015 | Jang | F25D 23/069 312/407 |
| 11,150,008 | B2 * | 10/2021 | Harikrishnasamy | F25D 23/062 |
| 11,549,743 | B1 * | 1/2023 | Bonazza | F25D 23/062 |
| 2006/0152126 | A1 * | 7/2006 | Collins | F25D 23/069 312/407 |
| 2009/0013710 | A1 * | 1/2009 | Cho | F25D 23/069 62/285 |
| 2018/0073798 | A1 * | 3/2018 | Bajak | F25D 23/064 |

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A refrigerator with a liner body and a beam, where the beam has an end portion, and the liner body has a liner wall. An insertion groove is on the liner wall, and the end portion is configured to be inserted into the insertion groove. A limit convex pin is on the end portion and a limit groove is on the liner wall and matched with a shape of the limit convex pin. The limit convex pin is configured to be inserted into the limit groove to limit rotation of the beam relative to the liner body. By matching the limit convex pin and the limit groove, the rotation of the beam relative to the liner wall is limited by the liner wall when the beam is under uneven forces, thereby reducing the flip probability of the beam of the refrigerator.

12 Claims, 3 Drawing Sheets

REFRIGERATOR

CROSS-REFERENCE TO RELATED APPLICATION

This application claims the priority, under 35 U.S.C. § 119, of Chinese Patent Application CN 202121541451.8, filed Jul. 7, 2021; the prior application is herewith incorporated by reference in its entirety.

FIELD AND BACKGROUND OF THE INVENTION

The present specification relates to the technical field of household appliances, and in particular, to a refrigerator.

Some existing refrigerators include a beam connected to a liner wall of a refrigerator liner, for example, an end portion of the beam is inserted into an insertion groove of the liner wall. In such refrigerators, the beam may flip relative to the liner under uneven forces, affecting user experience.

SUMMARY OF THE INVENTION

An aspect of embodiments of the present specification is to provide a refrigerator with a beam that does not easily flip, improving user experience.

The refrigerator includes a liner body and a beam, where the beam has an end portion, and the liner body has a liner wall. The refrigerator further includes an insertion groove located on the liner wall, and the end portion is configured to be inserted into the insertion groove. The refrigerator further includes a limit convex pin located on the end portion and a limit groove located on the liner wall and matched with a shape of the limit convex pin, and the limit convex pin is configured to be inserted into the limit groove to limit rotation of the beam relative to the liner body.

In such configurations, by matching between the limit convex pin and the limit groove, the rotation of the beam relative to the liner wall is limited by the liner wall when the beam is under uneven forces, thereby reducing the flip probability of the beam of the refrigerator.

In a possible implementation, the end portion further includes a first end, the liner wall includes a first liner wall, the insertion groove includes a first insertion groove located on the first liner wall, and the first end is configured to be inserted into the first insertion groove; the limit convex pin includes a first limit convex pin located on the first end, and the limit groove includes a first limit groove located on the first liner wall; the first limit convex pin extends along an axial direction of the beam, and the first limit groove is located in the first insertion groove; and the first limit convex pin has a first size in a first direction and a second size in a second direction, where the first size is greater than the second size, and the first direction and the second direction are perpendicular to each other and both perpendicular to the axial direction of the beam.

In a possible implementation, the end portion includes a first end, the liner wall includes a first liner wall, the insertion groove includes a first insertion groove located on the first liner wall, and the first end is configured to be inserted into the first insertion groove; the limit convex pin includes a first limit convex pin located on the first end, and the limit groove includes a first limit groove located on the first liner wall; the first limit convex pin extends along a radial direction of the beam, and the first limit groove extends from an edge of the first insertion groove.

In a possible implementation, the refrigerator includes at least two first limit convex pins, where the first limit convex pins are spaced around a circumferential direction of the beam.

In a possible implementation, the refrigerator includes four first limit convex pins, where an angle between two adjacent first limit convex pins is 90 degrees.

In a possible implementation, the refrigerator includes at least two first limit convex pins extending along opposite directions.

In a possible implementation, the end portion includes a second end opposite to the first end, the liner wall includes a second liner wall opposite to the first liner wall, the insertion groove includes a second insertion groove located on the second liner wall, and the second end is configured to be inserted into the second insertion groove; the limit convex pin includes a second limit convex pin located on the second end, and the limit groove includes a second limit groove located on the second liner wall; the second limit convex pin extends along the axial direction of the beam, and the second limit groove is located in the second insertion groove; and the second limit convex pin has a third size in the first direction and a fourth size in the second direction, where the third size is less than the fourth size.

In a possible implementation, the end portion includes a second end opposite to the first end, the liner wall includes a second liner wall opposite to the first liner wall, the insertion groove includes a second insertion groove located on the second liner wall, and the second end is configured to be inserted into the second insertion groove; the limit convex pin includes a second limit convex pin located on the second end, and the limit groove includes a second limit groove located on the second liner wall; the second limit convex pin extends along the radial direction of the beam, and the second limit groove extends from an edge of the second insertion groove.

In a possible implementation, the end portion includes a second end in mirror symmetry with the first end, and the liner wall includes a second liner wall in mirror symmetry with the first liner wall.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The technical solutions of this application are described in detail below with reference to specific embodiments. The described embodiments are merely some, rather than all, of the embodiments of this application. All other embodiments obtained by a person of ordinary skill in the art based on the embodiments of this application without creative efforts shall fall within the protection scope of this application.

The embodiments of the present specification provide one or more refrigerators 100.

Figure 3:
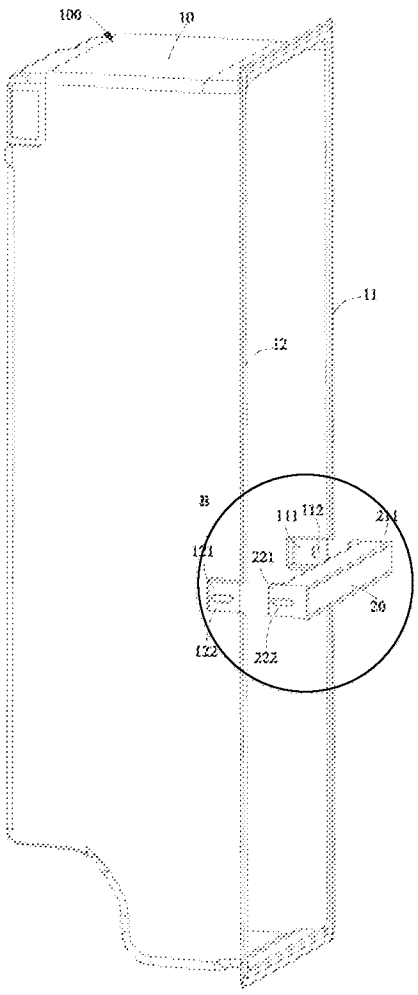
FIG. 3 is a partially exploded view of a third embodiment, showing a liner body and a beam.
Figure 2:
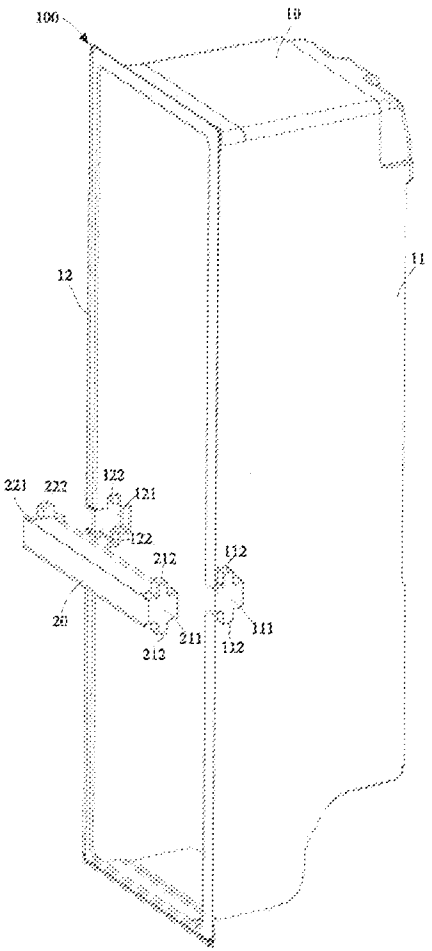
FIG. 2 is a partially exploded view of a second embodiment, showing a liner body and a beam.
Figure 1:
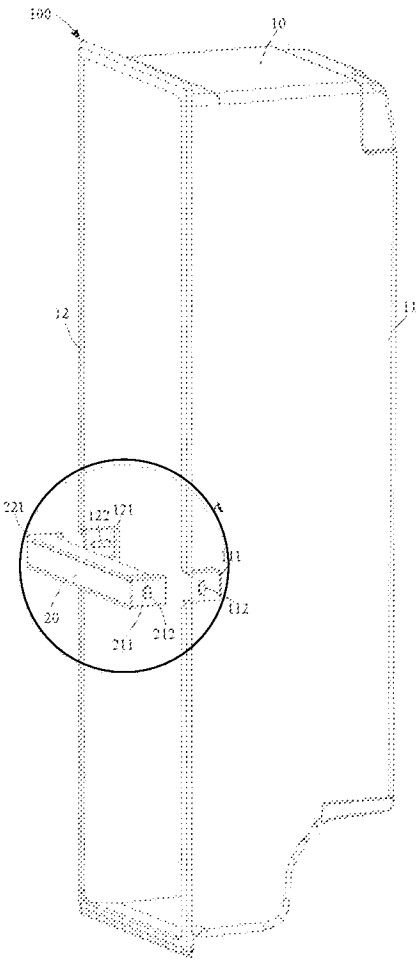
FIG. 1 is a partially exploded view of a first embodiment, showing a liner body and a beam.

FIG. 1 to FIG. 3 are partially exploded views of a refrigerator 100 provided by the embodiments of the present specification respectively. As shown in the figures, the refrigerator 100 includes a liner body 10 and a beam 20. The liner body 10 may be used for defining a storage compartment of the refrigerator 100. The beam 20 may strengthen the local structural strength of the refrigerator 100.

It can be understood by a person skilled in the art that, the refrigerator 100 may further include components, for example, a refrigeration cycle, a thermal insulation layer, and a door body, but since these are not the focus of the present specification, they are not shown in the accompanying drawings and are not described in detail.

In a first embodiment, referring to FIG. 1, the beam 20 is in an elongated shape, and includes a first end 211 and a second end 221 that are opposite; and the liner body 10 is in a box shape with one open side, and includes a first liner wall 11 and a second liner wall 12 that are opposite and separated.

The first liner wall 11 includes a first insertion groove 111, and the first insertion groove 111 is recessed in a direction away from the second liner wall 12 along an axial direction of the beam 20. The first end 211 of the beam 20 may be inserted into the first insertion groove 111. In FIG. 1, both the first end 211 of the beam 20 and the first insertion groove 111 are in a rectangular shape, but it can be understood by a person skilled in the art that, the first end 211 and the first insertion groove 111 may alternatively be in another shape. As long as the first end 211 may be inserted into the first insertion groove 111, the purpose of this embodiment can be achieved.

Further, the first end 211 and the first insertion groove 111 may be in a same shape.

Further, both the first end 211 and the first insertion groove 111 are in a polygonal shape. In this case, matching between the first end 211 and the first insertion groove 111 may also reduce the flip probability of the beam 20 to some extent.

In a specific implementation, a distance between the first liner wall 11 and the second liner wall 12 may be less than a length of the beam 20.

During assembly, the first liner wall 11 and/or the second liner wall 12 may be deformed by an external force, so that the distance between the first liner wall 11 and the second liner wall 12 at the first insertion groove 111 is greater than or equal to the length of the beam 20, and the first end 211 of the beam 20 takes the opportunity to be inserted into the first insertion groove 111. After the external force is lost, the first liner wall 11 and/or the second liner wall 12 return to the original shape. Because the first end 211 is limited by the first insertion groove 111, the beam 20 is fixed to the liner body 10.

Figure 4:
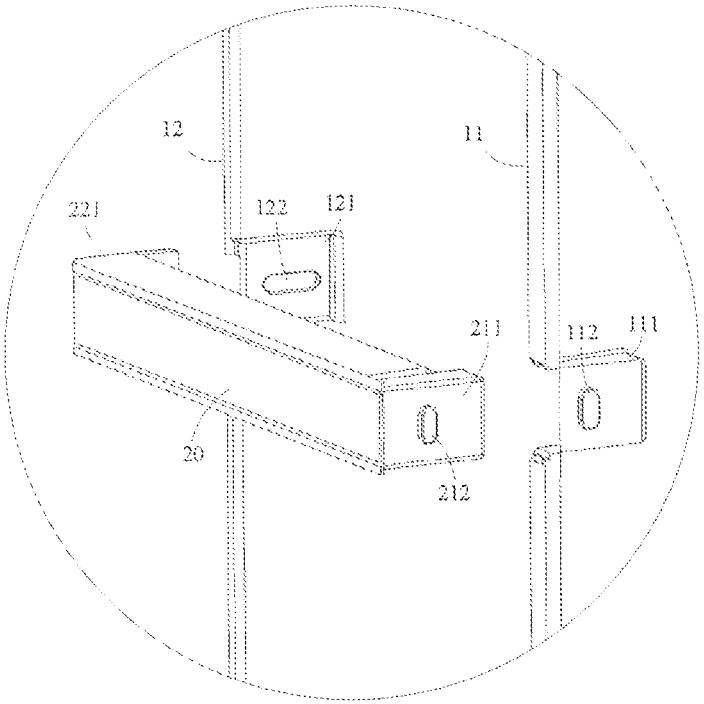
FIG. 4 is a partially enlarged view of position A in FIG. 1.
Figure 6:
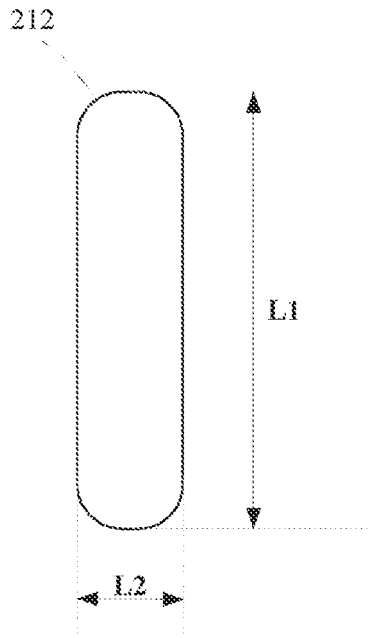
FIG. 6 is a partially enlarged view, showing a first limit convex pin in FIG. 4.
Figure 7:
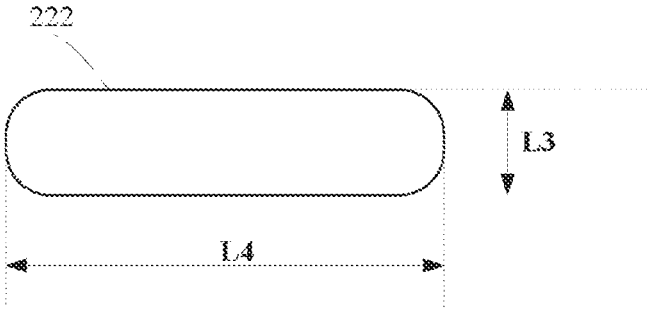
FIG. 7 is a partially enlarged view, showing a second limit convex pin in FIG. 5.

Still referring to FIG. 1 and with reference to FIG. 4 and FIG. 6, the beam 20 further includes a first limit convex pin 212, the first liner wall 11 further includes a first limit groove 112, and the first limit convex pin 212 is configured to be inserted into the first limit groove 112 to limit rotation of the beam 20 relative to the liner body 10.

The first limit convex pin 212 is located on the first end 211 of the beam 20 and extends along the axial direction of the beam 20. The first limit groove is located in the first insertion groove 111 and extends along the axial direction of the beam 20. In such configurations, in a process of assembling the beam 20 to the liner body 10, the first limit convex pin 212 may be also inserted into the first limit groove 112, thereby simplifying the assembly procedure. In addition, after the beam 20 is assembled to the liner body 10, both the first limit convex pin 212 and the first limit groove 112 are blocked and hardly to be seen, so that the product is more aesthetically pleasing.

Further, the first limit convex pin 212 has a first size L1 in a first direction, and has a second size L2 less than the first size L1 in a second direction, where the first direction and the second direction are perpendicular to each other and both perpendicular to the axial direction of the beam 20.

In a specific implementation, a cross section of the first limit convex pin 212 perpendicular to the axial direction of the beam 20 is a rectangle or rounded rectangle. An extension direction of a long side of the rectangle or rounded rectangle is the first direction, and an extension direction of a short side is the second direction. For example, the cross section of the first limit convex pin 212 perpendicular to the axial direction of the beam 20 is a rectangle with a length of 2.5 cm and a width of 0.8 cm. A person skilled in the art can adaptively adjust the shape and size of the first limit groove 112 so that the first limit groove is matched with the first limit convex pin 212.

In such configuration conditions, if the beam 20 flips, the long side of the first limit convex pin 212 tends to turn to a direction of the short side. However, the tendency is limited due to limitation of the first limit groove 112. Moreover, a greater distance between the first size L1 and the second size L2 indicates a better effect of limiting the rotation of the beam 20 relative to the liner body 10.

It can be understood by a person skilled in the art that, the first direction may be any direction perpendicular to the axial direction of the beam 20, for example, the first direction is perpendicular to the axial direction of the beam 20 and forms an angle of 45 degrees or any angle with a horizontal direction. In this case, the purpose of this embodiment can still be achieved.

Further, the first direction is perpendicular to the horizontal direction, and the second direction is parallel to the horizontal direction. When an item is taken from or placed in the refrigerator 100, the bottom of the item may slide back and forth on an item shelf and/or the beam 20, so that the beam 20 is subjected to a backward or forward force, and then the beam 20 has a tendency to flip backward or forward. A vertical size of the first limit convex pin 212 is greater than a horizontal size, which can limit rotation caused by a force in a front-rear direction.

As a variant example, the first direction is parallel to the horizontal direction, and the second direction is perpendicular to the horizontal direction. In some working conditions, weights of items in the storage compartment of the refrigerator 100 need to be supported by the beam 20, and the beam 20 may be subjected to a downward force in this case. In a case of uneven forces (for example, in a case that the items are closer to a rear portion of the beam 20, the beam 20 has a tendency to flip backward), the beam 20 may flip. When a force that causes the beam 20 to flip is perpendicular to a long side and/or a length of the long side is longer, a torque that can cause the beam 20 to flip is greater. In other words, a greater first size L1 in the horizontal direction indicates a better anti-flip effect.

A difference of the second embodiment from the first embodiment lies in the first limit convex pin 212 and the first limit groove 112, and therefore the same parts as those in the first embodiment are omitted.

The first limit convex pin 212 is located on the first end 211 and extends along a radial direction of the beam 20, and the first limit groove 112 extends from an edge of the first insertion groove 111. Compared with the first embodiment, the first limit groove 112 is more easily formed on the liner body 10, and integrity of the first insertion groove 111 and the first limit groove 112 on the first liner wall 11 is more easily maintained.

Still referring to FIG. 2, the first end 211 of the beam 20 includes two first limit convex pins 212, where one extends upward from an upper surface of the first end 211, and the other one extends downward from a lower surface of the first end 211. In view of this, it can be understood by a person skilled in the art that, in a case that only one first limit convex pin 212 and one first limit groove 112 are included, or in a case that a plurality of first limit convex pins 212 and a plurality of first limit grooves 112 are included, the purpose of this embodiment can still be achieved. For example, in a variant example, only one first limit convex pin 212 and one first limit groove 112 are included. In another variant example, four first limit convex pins 212 and four first limit grooves 112 are included, the four first limit convex pins 212 are evenly spaced on a circumferential surface of the first end 211, and the four first limit grooves 112 also extend in different directions from the edge of the first insertion groove 111.

Therefore, when only one first limit convex pin 212 and one first limit groove 112 are included, the first limit convex pin 212 and the first limit groove 112 may extend along any direction.

When two first limit convex pins 212 and two first limit grooves 112 are included, preferably, the two first limit convex pins 212 and the two first limit grooves 112 may extend along opposite directions, for example, upward and downward, and forward and backward. When more first limit convex pins 212 and more first limit grooves 112 are included, the first limit convex pins 212 are evenly or unevenly spaced around the axial direction of the beam 20. For example, in a variant example in which four first limit convex pins 212 and one limit groove are included, an angle between two adjacent first limit convex pins 212 is 90 degrees. The first liner wall 11 relies on its own strength to overcome the force that causes the beam 20 to flip. In such configurations, distribution of forces on the first liner wall 11 is more even. On one hand, the anti-flip effect is better. On the other hand, a probability that the first liner wall 11 is deformed due to uneven forces is reduced.

The refrigerator 100 provided by the third embodiment may be an improvement for any refrigerator 100 in the first embodiment and the second embodiment.

A second insertion groove 121 is formed on a second liner wall 12 of the refrigerator 100, and a second end 221 of the beam 20 may be inserted into the second insertion groove 121. Similar to the form of the first insertion groove 111, the second insertion groove 121 extends in a direction away from a first liner wall 11 along an axial direction of the beam 20.

The second end 221 of the beam 20 includes a second limit convex pin 222, a second limit groove 122 is formed on the second liner wall 12, and the second limit convex pin 222 may be inserted into the second limit groove 122 to limit rotation of the beam 20 relative to the liner body 10. In such configurations, both two ends of the beam 20 are limited, thereby further improving an anti-flip effect of the beam 20.

Figure 5:
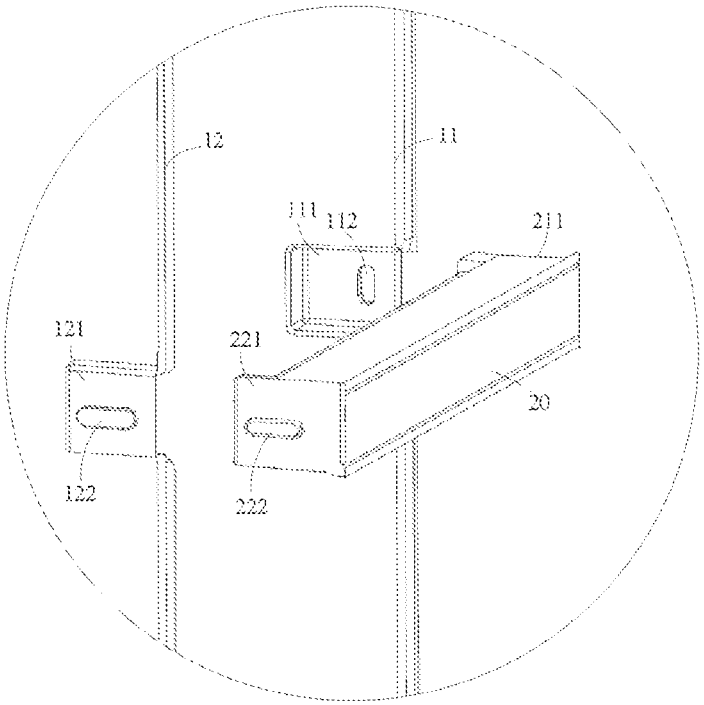
FIG. 5 is a partially enlarged view of position B in FIG. 3.

In a specific implementation, referring to FIG. 1, FIG. 3, and FIG. 5, an end portion of the second end 221 includes a second limit convex pin 222 extending along the axial direction of the beam 20. The second insertion groove 121 includes a second limit groove 122 recessed and extending along the axial direction of the beam 20.

Further, the second limit convex pin 222 has a third size L3 in a first direction, and has a fourth size L4 greater than the third size L3 in a second direction, where the first direction and the second direction are perpendicular to each other and both perpendicular to the axial direction of the beam 20.

In such configurations, both the two ends of the beam 20 are limited to generate an effect of preventing the beam 20 from flipping, one end focuses on preventing flipping caused by uneven forces in an up-down direction, and the other end focuses more on preventing flipping caused by uneven forces in a front-rear direction. When both of the two ends limit the beam 20 simultaneously, the effect is better.

In a specific implementation, referring to FIG. 2, an end portion of the second end 221 includes a second limit convex pin 222 extending along a radial direction of the beam 20. A second limit groove 122 extending is formed on an inner edge of the second insertion groove 121.

As a variant example, the second end 221 of the beam 20 may be arranged in mirror symmetry with the first end 211, and the second liner wall 12 of the liner body 10 may be arranged in mirror symmetry with the first liner wall 11. In such configurations, the two ends of the beam 20 and the two liner walls can be manufactured by using a same mold or tool, making it convenient in manufacturing.

Although specific implementations have been described above, these implementations are not intended to limit the scope of this application, even if only one implementation is described with respect to specific features. The feature example provided in this application is intended to be illustrative rather than limiting, unless otherwise stated. During specific implementation, according to an actual requirement, in a technically feasible case, the technical features of one or more dependent claims may be combined with the technical features of the independent claims, and the technical features from the corresponding independent claims may be combined in any appropriate way instead of using just specific combinations listed in the claims.

The various specific implementations described above and shown in the accompanying drawings are only used to illustrate this application, but are not all of this application. Any variation made by a person of ordinary skill in the art to this application within the scope of the basic technical concept of this application shall fall within the protection scope of this application.

The invention claimed is:

1. A refrigerator, comprising:

a liner body having a liner wall formed with an insertion groove;

a beam having an end portion configured to be inserted into said insertion groove;

a limit convex pin on said end portion and a limit groove on said liner wall in said insertion groove;

said limit groove having a shape corresponding to a shape of said limit convex pin, and said limit convex pin being configured to be inserted into said limit groove and to limit rotation of said beam relative to said liner body.

2. The refrigerator according to claim 1, wherein:

said limit convex pin extends along an axial direction of said beam; and said limit convex pin has a first size in a first direction and a second size in a second direction, said first size is greater than said second size, and said first direction and said second direction are perpendicular to each other and both perpendicular to said axial direction of said beam.

3. The refrigerator according to claim 2, wherein:

said end portion of said beam is a first end portion, and said beam has a second end portion opposite to said first end portion in an axial direction of said beam;

said liner wall of said liner body is a first liner wall, and said liner body has a second liner wall opposite to said first liner wall;

said insertion groove is a first insertion groove on said first liner wall, and a second insertion groove is on said second liner wall, said second end portion is configured to be inserted into said second insertion groove;

said limit convex pin is a first limit convex pin on said first end portion, a second limit convex pin is on said second end portion, and said limit groove is a first limit groove on said first liner wall in said first insertion groove, a second limit groove on said second liner wall in said second insertion groove;

said second limit convex pin extends along said axial direction of said beam; and said second limit convex pin has a third size in said first direction and a fourth size in said second direction, wherein said third size is less than said fourth size.

4. The refrigerator according to claim 2, wherein said end portion of said beam is first end portion, and said beam has a second end portion opposite to said first end portion in an axial direction of said beam;

said liner wall of said liner body is a first liner wall, and said liner body has a second liner wall opposite to said first liner wall;

said insertion groove is a first insertion groove on said first liner wall, and a second insertion groove is on said second liner wall, said second end portion is configured to be inserted into said second insertion groove;

said limit convex pin is a first limit convex pin on said first end portion, a second limit convex pin is on said second end portion, and said limit groove is a first limit groove on said first liner wall in said first insertion groove, a second limit groove on said second liner wall in said second insertion groove;

said second limit convex pin extends along said radial direction of said beam, and said second limit groove extends from an edge of said second insertion groove.

5. The refrigerator according to claim 2, wherein said end portion of said beam is a first end portion, said beam has a second end portion in mirror symmetry with said first end, and said liner wall of said liner body is a first liner wall, and said liner body has a second liner wall in mirror symmetry with said first liner wall.

6. The refrigerator according to claim 1, wherein said first limit convex pin extends along a radial direction of said beam, and said limit groove extends from an edge of said insertion groove.

7. The refrigerator according to claim 6, wherein said limit convex pin is at least two limit convex pins, and said at least two limit convex pins are spaced around a circumferential direction of said beam.

8. The refrigerator according to claim 6, wherein said limit convex pin is four limit convex pins having an angle between two adjacent first limit convex pins of 90 degrees.

9. The refrigerator according to claim 6, wherein said limit convex pin is two limit convex pins extending along opposite directions.

10. The refrigerator according to claim 6, wherein said end portion of said beam is a first end portion, said beam has a second end portion in mirror symmetry with said first end, and said liner wall of said liner body is a first liner wall, and said liner body has a second liner wall in mirror symmetry with said first liner wall.

11. The refrigerator according claim 6, wherein:

said end portion of said beam is a first end portion, and said beam has a second end portion opposite to said first end portion in an axial direction of said beam;

said liner wall of said liner body is a first liner wall, and said liner body has a second liner wall opposite to said first liner wall;

said insertion groove is a first insertion groove on said first liner wall, and a second insertion groove is on said second liner wall, said second end portion is configured to be inserted into said second insertion groove;

said limit convex pin is a first limit convex pin on said first end portion, a second limit convex pin is on said second end portion, and said limit groove is a first limit groove on said first liner wall in said first insertion groove, a second limit groove on said second liner wall in said second insertion groove;

said second limit convex pin extends along said axial direction of said beam; and said second limit convex pin has a third size in said first direction and a fourth size in said second direction, wherein said third size is less than said fourth size.

12. The refrigerator according to claim 6, wherein said end portion of said beam is first end portion, and said beam has a second end portion opposite to said first end portion in an axial direction of said beam;

said liner wall of said liner body is a first liner wall, and said liner body has a second liner wall opposite to said first liner wall;

said insertion groove is a first insertion groove on said first liner wall, and a second insertion groove is on said second liner wall, said second end portion is configured to be inserted into said second insertion groove;

said limit convex pin is a first limit convex pin on said first end portion, a second limit convex pin is on said second end portion, and said limit groove is a first limit groove on said first liner wall in said first insertion groove, a second limit groove on said second liner wall in said second insertion groove;

said second limit convex pin extends along said radial direction of said beam, and said second limit groove extends from an edge of said second insertion groove.

* * * * *